US006129162A

United States Patent [19]

Hauptmann

[11] Patent Number: 6,129,162

[45] Date of Patent: Oct. 10, 2000

[54] ROCK DRILL

[75] Inventor: Udo Hauptmann, München, Germany

[73] Assignee: Hilti Aktiengesellschaft, Schaan, Liechtenstein

[21] Appl. No.: 09/096,415

[22] Filed: Jun. 11, 1998

[30] Foreign Application Priority Data

Jun. 10, 1997 [DE] Germany ..... 197 24 373

[51] Int. Cl.[7] ..... E21B 10/44

[52] U.S. Cl. ..... 175/394; 175/415

[58] Field of Search ..... 175/394, 395, 175/427, 414, 415, 420.1; 408/224, 225, 223, 230

[56] References Cited

U.S. PATENT DOCUMENTS 4,889,200 12/1989 Moser ..... 175/394
5,482,124 1/1996 Haussmann et al. ..... 175/415
5,492,187 2/1996 Neukirchen et al. ..... 175/394
5,779,403 7/1998 Kleine et al. ..... 408/230

*Primary Examiner*—David Bagnell
*Assistant Examiner*—Elaine Gort
*Attorney, Agent, or Firm*—Brown & Wood, LLP

[57] ABSTRACT

A rock drill has an axially extending drill shaft (2) with at least one helically shaped drilled material removal groove (3) and a drillhead (5) formed of a hard metal alloy. The drillhead (5) is secured to an end face of the drill shaft (2) such as by welding or soldering and has a main cutter (6) extending along a diagonal of the drillhead and at least one supplementary cutter (7, 8) extending along another diagonal of the drillhead. The supplementary cutter (7, 8) projects axially outwardly from a radially outer section of the main cutter (6).

11 Claims, 2 Drawing Sheets

ROCK DRILL

BACKGROUND OF THE INVENTION

The present invention is directed to a rock drill with an axially extending drill shaft having at least one helical drilled material removal groove extending in its axial direction. A drill head formed of a hard metal alloy is securely attached to one end of the drill shaft. The drill head has a pair of intersecting diagonals with a main cutter extending along one of the diagonals and at least one supplementary cutter extending along the other diagonal.

Rock drills are used in axially directed impact-supported rotary drilling equipment normally used for forming boreholes or openings in concrete or masonry by rotating impacts. It is well known, when drilling in hard rock and at high drilling speeds, rock drills wear very rapidly in the region of the drill tip. Accordingly, rock drills are faced with a hard metal alloy. In the present case, hard metal alloys are defined as centered or fused carbide, silicides, borides or their alloys.

Such a rock drill is disclosed in EP-A-O 654 580. This rock drill has a drill head formed, as a whole, of a hard metal connected with the drill shaft by soldering or welding. The cross section of the drill head is essentially rectangular, with cutters arranged on each diagonal. The cutters serve for wearing away the rock and provide lateral guidance for the rock drill in the borehole. The cutters are composed of a main cutter extending along one diagonal, and two supplementary cutters arranged parallel to another diagonal, inclined with respect to the first diagonal. The cutters are positioned in such a way that the main cutter and the supplementary cutters describe the same enveloping curve as the rock drill is rotated. The main cutter is roof-shaped and centers the rock drill while assuring the main removal of the drilled material, in that it engages the rock being worked before the supplementary cutters do. The drilled material or drillings, removed by the main cutter, are thrown into the radially outer peripheral region of the drillhead and are further comminuted by the supplementary cutters, which are set back axially with respect to the main cutter.

This known rock drill is distinguished by a high drilling performance, a long service of life and good discharge of the drilled material. Nevertheless, there is the desire to improve the drilling performance even further. In particular, the rock drill is to be further developed for optimizing the cutters with respect to their specific stress. In this regard, it should be noted, that due to the axial impact of the rotary impact drill, the central part of the main cutter is subjected to stresses different from those experienced by the radially outer regions of the main cutter or the supplementary cutters, such as shearing forces. Especially when a borehole is being drilled, the total impact energy of the rotary impact drill must be absorbed by the central part of the main cutter.

SUMMARY OF THE INVENTION

Therefore, a primary object of the present invention is to modify a rock drill of the known type, so that the different stresses acting on the cutters during drilling operations are taken into consideration. At the same time, the productive capacity of the drilling tool is to be further improved and a very effective transport of the drillings from the drilling site is to be assured.

In accordance with the present invention, a rock drill is improved by providing the main cutter with a pair of radially outer sections extending along the diagonal from opposite ends of the center section and with the at least one supplementary cutter projecting outwardly in the axial direction of the drill shaft beyond the outer sections of the main cutter.

Accordingly, the rock drill of the present invention has a drill shaft with at least one drilled material removal groove extending helically along its axial extent and a drillhead formed completely of a hard metal alloy. The drillhead is secured with one end face of the drill shaft by welding or soldering, and it has a main cutter as well as at least one supplementary cutter located along intersecting diagonals of the drillhead. The supplementary cutter projects axially outwardly from the radially outer regions of the main cutter.

Since the at least one supplementary cutter projects axially beyond the outer regions of the main cutter, the supplementary cutter takes over the bulk of the removal of the material being drilled. Due to the inventive arrangement of the at least one supplementary cutter, it experiences the greatest shear stress during the drilling of a borehole. The radially outer regions of the main cutter, set back axially with respect to the at least one supplementary cutter merely afford a centering function. As a result, the main cutter can be optimized even further, for example, reinforced, with respect to its centering function. The centering function of the main cutter is retained, over the service life of the rock drill, even if the supplementary cutter has been subjected to some wear. The supplementary cutter extends for only a portion of the diagonal of the drillhead on which it is located, as a result, the shearing stresses are kept within limits. The axial impact energy is introduced into the material being drilled, only by the main cutter, acting as a centering point or, as a further consequence, over the supplementary cutter. The effectiveness of introducing the impact energy into the material being drilled is increased even further in comparison to known rock drills, since the pressure on the material being drilled is increased. At the transition from the main cutter to the supplementary cutter, projecting axially outwardly from the radially outer regions of the main cutter, a shear stress is built up additionally during the drilling in the material and supports the progress of the drilling.

Preferably, the at least one supplementary cutter projects beyond the radially outer regions of the main cutter also in a radial direction. As a result, the radially outer peripheral regions of the main cutter do not participate in the removal of the material being drilled from the borehole wall and merely fulfill a guiding action for the rock drill.

For reasons of symmetry, it is advantageous if two supplementary cutters are located along one of the diagonals of the drillhead on opposite sides of the center region of the main cutter. The diagonal of the supplementary cutters encloses an angle of less than 90° with the diagonal of the main cutter. Preferably, this angle is in the range of about 10° to 50°. Due to the arrangement of the two supplementary cutters, the synchronism of the drilling tool in the borehole being drilled is improved. The inventive arrangement of the supplementary cutters and of the main cutter offer the advantage that the drilled material removal grooves in the drillhead can be made larger. With enlarged removal grooves on opposite long sides of the drill head, it is possible to use less hard metal alloy. Overall, an approximately X-shaped outer contour results in the axial projection for the drillhead.

To provide the centering function, the main cutter has a central region, preferably roof-shaped in the direction of its diagonal. The roof-shaped central region projects axially outwardly from the supplemental cutters and has a radial extent smaller than or equal to one-third of the largest diagonal dimension of the drillhead. The central region of the main cutter formed in this manner, is optimized with respect to the transfer of the axial impacts of the rotary impact drilling equipment. Due to its roof-shaped contour and the selected radial dimensions, it offers only a relatively slight area of attack for the shear forces during the penetration of the drillhead into the material being drilled. This improves the service life of the main cutter and of the drillhead.

It is advantageous if the supplementary cutters have a combined radial length of more than two-thirds of the largest radial dimension of the drillhead. As a result, a good drilled material removal performance is insured and the shear forces, acting on the supplementary cutters during drilling operation, can be kept low.

For the optimum introduction of the force vector, it has proven to be advantageous if the supplementary cutters have a radially extending cutting edge enclosing an angle of approximately 90° with the axis of the drill shaft. In particular in such an arrangement, an especially good milling effect of the supplementary cutting edges is achieved.

In principle, the supplementary cutters can, in relation to the rotational movement during drilling operation, lead or trail the radially outer regions of the main cutter. For the progress of the drilling operation, it has proven to be advantageous if the supplementary cutters lead the main cutter. A particularly good arrangement is provided if in each case main removal grooves for the drilled material are assigned to the supplementary cutters.

The guiding function of the radially outer peripheral ends of the main cutter is improved if such surfaces, extending parallel to the shaft axis, have a curvature matched to the curvature of the outside surface of the drill shaft. If the radially outer regions of the main cutter, projecting beyond the shaft, contact the wall of the borehole, due to their curved shape, they only slide along the borehole wall and do not contribute to the abrasive removal of the material being drilled. Accordingly, the friction of the drilling tool in the borehole is reduced.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
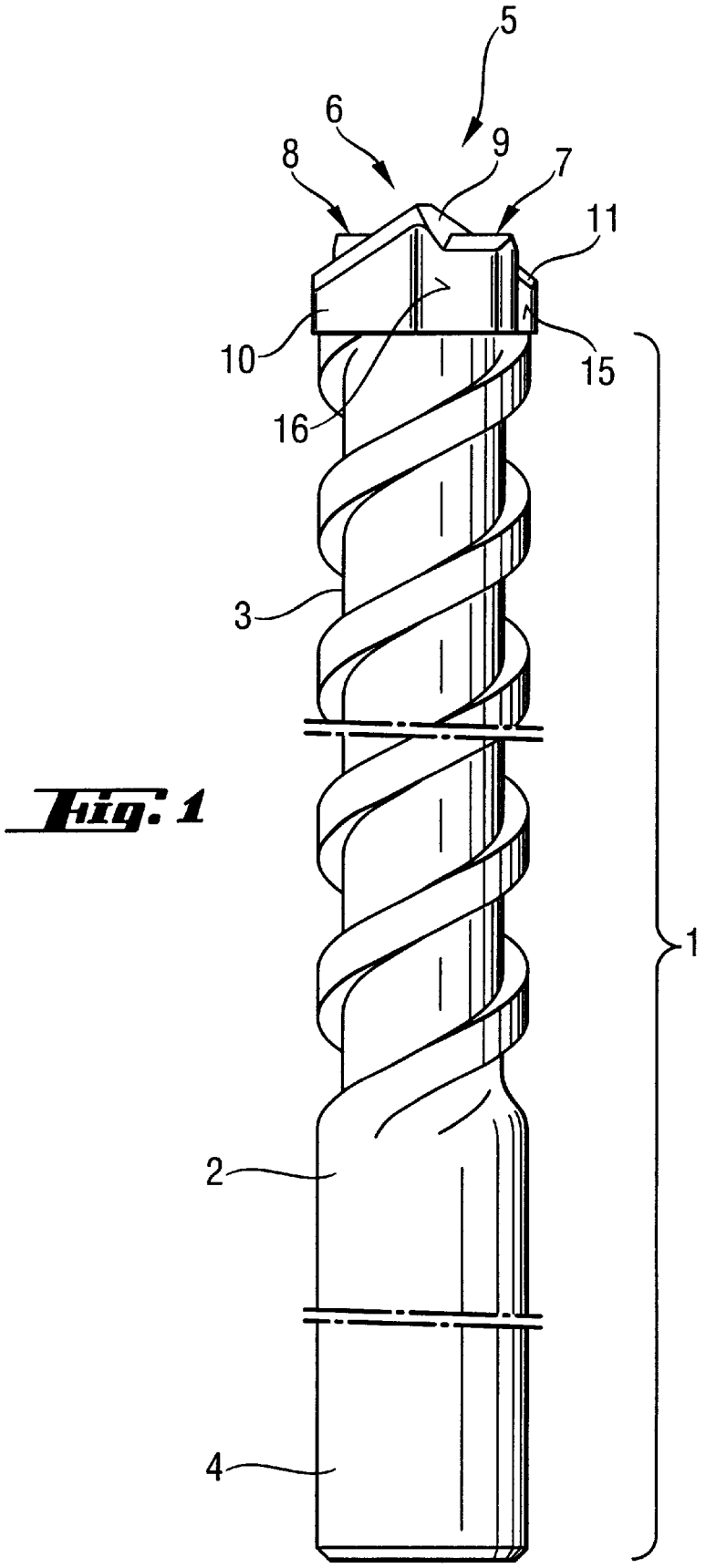
FIG. 1 is an axially extending side view of a rock drill embodying the present invention.
Figure 2:
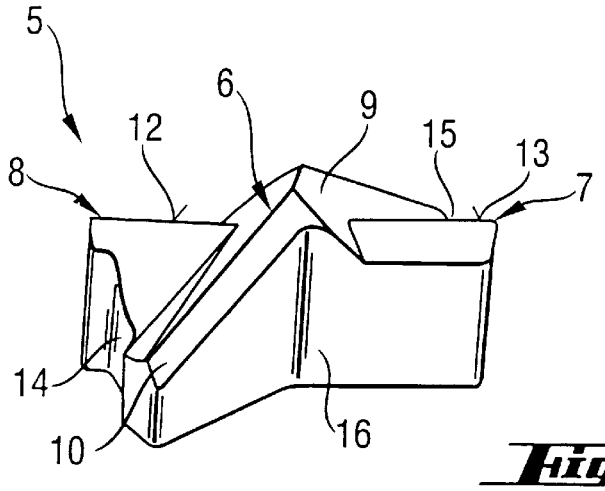
FIG. 2 is a perspective view of the drillhead illustrated in FIG. 1.
Figure 3:
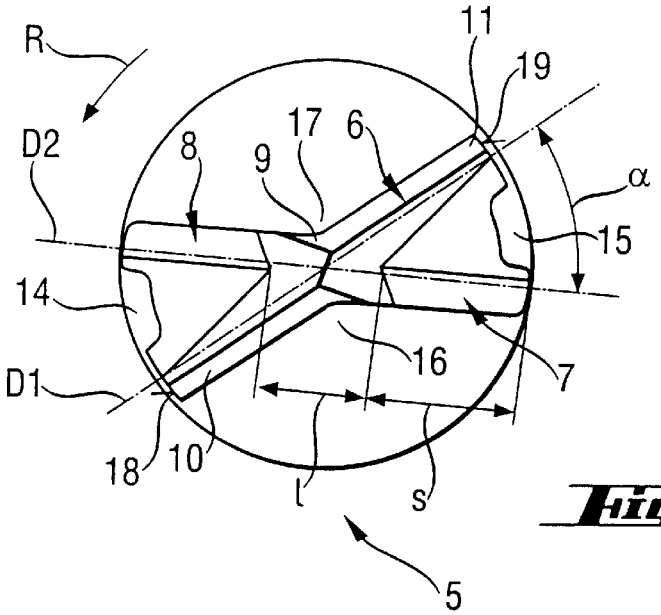
FIG. 3 is a plan view of the drillhead of FIG. 1.

A rock drill, as shown in FIGS. 1 to 3 has as an axially extending drill shaft 2 with a first end at the upper end in FIG. 1 and a second end of the lower end in FIG. 1. The drill shaft 2 has axially extending drilled material grooves 3 extending from its first end towards its second end. The drilled material removal grooves 3 are helically shaped. At the second end of the drill shaft 2 there is an axially extending shank 4 to be received in the chuck of a rotary impact drill, not shown. A rotary impact drill may be a high-performance hammer drill as provided by the assignee, Hilti Aktiengesellshaft. At its first end, that is, the opposite end from the shank 4, the drill shaft is equipped with a drillhead 5 extending axially outwardly from the first end of the drill shaft. The drillhead 5 is formed of a hard metal alloy. In the present case, a hard metal alloy is understood to be sintered or fused carbide, silicide, boride or their alloys. The drillhead 5 is secured to the first end of the drill shaft 2 by soldering or welding.

As can be seen best in FIG. 3, the drillhead has a pair of diagonals D1, D2 extending transversely of the axis of the drill shaft 2 with a main cutter 6 located on the diagonal Dl and two supplementary cutters 7, 8 located on the diagonal D2 on opposite sides of the main cutter 6. The diagonals D1, D2 intersect in approximately the center of the drillhead. The diagonals D1, D2, on which the cutting edges 6, 7, 8 are located, form an angle $\alpha$, which is less than 90°. Preferably, the angle $\alpha$ is in the range of about 10° to 50°. As shown in FIGS. 1 and 2, the main cutter 6 has a peaked roof shape in the diagonal direction, that is, it slopes outwardly and rearwardly from the tip of the main cutter. As a result, the main cutter 6 has a central region 9 extending in both directions from the axially outer tip with a radially outer region 10, 11 extending from each end of the central region 9. The central region 9 of the main cutter 6 extends axially outwardly from the supplementary cutters 7, 8 and functions as a centering point during the operation of the drill. As can be seen in FIG. 3, in the direction of the diagonal D2, the central region has a diagonally extending dimension 1 less than or equal to ⅓ of the largest diagonal dimension of the drillhead 5.

The supplementary cutters 7, 8 extend over only a portion of the length of the diagonal D2 and each has a diagonal length s, greater than ⅔ of half the diagonal dimension of the drillhead 5. The supplementary cutters 7, 8 project beyond the radially outer regions 10, 11 of the main cutter 6 at least in the axial direction. Advantageously, as can be seen in FIG. 3, they project in the radial direction from the radially outer peripheral edges or ends 18, 19 of the outer regions 10, 11 of the main cutter 6. As shown in FIG. 2, the supplementary cutters 7, 8 each have a radially extending cutter edge 12, 13 extending at an angle of 90°, that is, approximately perpendicularly, to the axis of the drill shaft 2. Between the supplemental cutters 7, 8 and the outer regions 10, 11 of the main cutter 6, the drillhead 5 has axially extending grooves 14, 15, which discharge into the removal grooves 3 of the drill shaft and facilitate the passage of the drilled material away from the drillhead. The drillhead has shorter sides containing the grooves 14, 15 and longer sides forming concave or V-shaped recesses 16, 17 serving as the main drilled material removal grooves and discharging into the removal grooves 3 on the drill shaft 2.

As shown in FIG. 3, the drill shaft 2 and the drillhead 5 rotate in the direction R. During drilling operation, the supplementary cutters 7, 8 lead the radially outer regions 10, 11 of the main cutter 6. Accordingly, the concave or generally flattened V-shaped main removal grooves 16, 17 are assigned to the supplementary cutters 7, 8 responsible for the removal of the bulk of the drilled material. The radially outer regions 10, 11 of the main cutter 6 serve to guide the rock drill 1 in the borehole being formed. To improve the guidance properties and to reduce the friction in the borehole, the axially extending end faces 18, 19 of the radially outer regions 10, 11 are curved. Moreover, their curvature corresponds approximately to the curvature of the drill shaft 2, that is the outer surface of the drill shaft.

Figure 4:
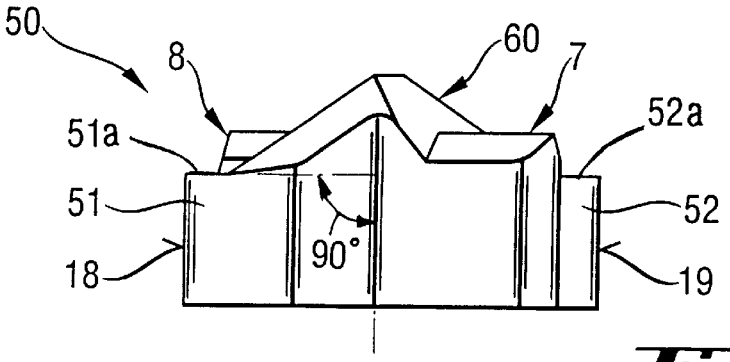
FIG. 4 is a side elevational view of another embodiment of the drillhead.

In FIG. 4 a second embodiment of a drill head 50 is illustrated and corresponds mainly to the drill head 5 of FIGS. 1 to 3. The difference between the two embodiments is that the radially outer regions 51, 52 of the main cutter 60 have a radially extending surface 51*a*, 52*a* forming an angle of 90° with the axis of the drill shaft. As a result, the guiding function of the radially outer regions 51, 52 of the main cutter 60 is improved.

While specific embodiments of the invention have been shown and described in detail to illustrate the inventive principles, it will be understood that the invention may be embodied otherwise without departing from such principles.

What is claimed is:

1. A rock drill comprises an axially extending drill shaft (2) having a first end and a second end with at least one helical drilled material removal groove extending from adjacent the first end toward the second end, a drillhead (5; 50) formed of a hard metal alloy securely attached to and projecting axially outwardly from the first end of said drill shaft (2), said drillhead transversely of the axial direction of said drill shaft has a long direction and a short direction extending transversely of the long direction with a first diagonal (D1) extending generally in the long direction and a second diagonal (D2) intersecting said first diagonal at approximately the axis of said drill shaft and extending generally in the long direction, a main cutter (6; 60) formed by said drillhead extending along said first diagonal (D1) and having a center section extending in the direction of said first diagonal in both directions from the intersection of said first and second diagonals and extending for a part of the length of the first diagonal, at least one supplementary cutter (7, 8) formed by said drillhead extending along a part of said second diagonal from the center section of said main cutter, said main cutter having a pair of radially outer sections (10, 11; 51, 52) extending radially outwardly along the first diagonal each from an opposite end of said center section, and said supplementary cutter projecting outwardly in the axial direction of said drill shaft beyond said outer sections of said main cutter.

2. A rock drill, as set forth in claim 1, wherein said outer sections (10, 11; 51, 52) of said main cutter (6; 60) have radially outer end surfaces extending in the axial direction of said drill shaft (2), and said at least one supplementary cutter (7, 8) projects radially outwardly from one of said end surfaces (18, 19) of said outer regions (10, 11) of said main cutter (6; 60).

3. A rock drill, as set forth in claim 1 or 2, wherein two said supplementary cutters (7, 8) are located along said second diagonal (D2) of said drillhead (2) and said second diagonal (D2) forms an angle ($\alpha$) of less than 90° with said first diagonal (D1).

4. A rock drill, as set forth in claim 3, wherein said second diagonal (D2) forms an angle ($\alpha$) with said first diagonal (D1) in the range of about 10° to 50°.

5. A rock drill, as set forth in claim 3, wherein each of said supplementary cutters (7, 8) have a dimension in the direction of the second diagonal (D2) greater than ⅔ of half a largest diagonal dimension of said drillhead (5; 50).

6. A rock drill, as set forth in claim 3, wherein said supplementary cutters (7, 8) each has a radially extending cutting edge (12, 13) forming an angle of about 90° with the axis of said drill shaft (2).

7. A rock drill, as set forth in claim 3, wherein said drill shaft (2) and said drillhead (5; 50) rotate around the drill shaft axis in a rotational direction (R), the supplementary cutters (7, 8) lead in the rotational direction (R) the outer regions (10, 11; 51, 52) of said main cutter (6; 60), respectively, and a main drilled material removal groove (16, 17) trails each of said supplementary cutters (7, 8) in the rotational direction (R).

8. A rock drill, as set forth in claim 3, wherein said drillhead (5; 50) has circumferentially extending radially outer end walls extending in the short direction thereof and each said end wall has an axially extending second removal groove (14, 15) extending into one of said removal grooves (3) in said drill shaft (2).

9. A rock drill, as set forth in claim 1 or 2, wherein in the direction of said first diagonal (D1) said center section (9) is a peaked roof-shaped center region (9), said central region (9) projects axially outwardly in the direction of said drill shaft axis from said at least one supplementary cutter (7, 8) and has a dimension in the diagonal direction of diagonal (D1) less than or equal to ⅓ of a largest diagonal dimension of said drillhead (5; 50).

10. A rock drill, as set forth in claim 1 or 2, wherein said outer sections (51, 52) of said main cutter (60) have a radially extending surface 51*a*, 52*a* facing outwardly in the axial direction extending at an angle of about 90° with the axis of said drill shaft (2).

11. A rock drill, as set forth in claim 1 or 2, wherein each of said outer sections (10, 11; 51, 52) of said main cutter (6; 60) have radially outer end surfaces extending parallel to the axis of said shaft (2) and having a curvature in the circumferential direction of said drill shaft (2) corresponding approximately to the curvature of said drill shaft.

* * * * *